US010784034B2

(12) United States Patent
Yang et al.

(10) Patent No.: US 10,784,034 B2
(45) Date of Patent: Sep. 22, 2020

(54) CORE STRUCTURE AND MAGNETIC DEVICE

(71) Applicant: Delta Electronics (Shanghai) CO., LTD, Shanghai (CN)

(72) Inventors: Haijun Yang, Shanghai (CN); Zengyi Lu, Shanghai (CN); Weilong Xia, Shanghai (CN); Guodong Yin, Shanghai (CN); Jinfa Zhang, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 209 days.

(21) Appl. No.: 15/600,975

(22) Filed: May 22, 2017

(65) Prior Publication Data

US 2017/0345541 A1 Nov. 30, 2017

(30) Foreign Application Priority Data

May 25, 2016 (CN) ..... 2016 1 0353368

(51) Int. Cl.

| | |
|---|---|
| ***H01F 27/28*** | (2006.01) |
| ***H01F 17/04*** | (2006.01) |
| ***H01F 27/40*** | (2006.01) |
| ***H01F 3/10*** | (2006.01) |

(52) U.S. Cl.

CPC ..... *H01F 17/04* (2013.01); *H01F 3/10* (2013.01); *H01F 27/2804* (2013.01); *H01F 27/2823* (2013.01); *H01F 27/40* (2013.01)

(58) Field of Classification Search

USPC ..... 336/170, 221, 213, 220, 182, 184

See application file for complete search history.

(56) References Cited

U.S. PATENT DOCUMENTS

| | | | | |
|---|---|---|---|---|
| 7,187,263 | B2 | 3/2007 | Vinciarelli | |
| 8,421,578 | B2 * | 4/2013 | Huang | H01F 3/14 336/212 |
| 2005/0024179 | A1 * | 2/2005 | Chandrasekaran | H01F 27/24 336/212 |
| 2005/0110606 | A1 * | 5/2005 | Vinciarelli | H01F 27/2804 336/200 |
| 2008/0024259 | A1 | 1/2008 | Chandrasekaran et al. | |

(Continued)

FOREIGN PATENT DOCUMENTS

| | | |
|---|---|---|
| CN | 201160024 Y | 12/2008 |
| CN | 101802941 A | 8/2010 |
| CN | 101989483 A | 3/2011 |

(Continued)

OTHER PUBLICATIONS

The Chinese 1OA issued by CNIPA dated Jul. 30, 2018.
The CN3OA dated Jan. 19, 2020 by the CNIPA.

*Primary Examiner* — Elvin G Enad
*Assistant Examiner* — Kazi S Hossain
(74) *Attorney, Agent, or Firm* — Yunling Ren

(57) ABSTRACT

A core structure includes a first magnetic cover, a second magnetic cover, and at least two winding columns and at least one common side column provided between the first magnetic cover and the second magnetic cover and opposite to each other. The side wall of the common side column towards the at least two winding columns is provided with at least one first protrusion which extends towards the gap formed between the two adjacent winding columns.

21 Claims, 10 Drawing Sheets

(56) References Cited

U.S. PATENT DOCUMENTS

| | | | | |
|---|---|---|---|---|
| 2010/0321960 | A1* | 12/2010 | Nakahori | H01F 27/2804<br>363/21.04 |
| 2014/0266530 | A1* | 9/2014 | Andres | H01F 27/29<br>336/170 |

FOREIGN PATENT DOCUMENTS

| | | | |
|---|---|---|---|
| CN | 102360852 | B | 9/2013 |
| CN | 205104331 | U | 3/2016 |
| CN | 105518810 | A | 4/2016 |
| JP | 2007227914 | A | 9/2007 |

* cited by examiner

CORE STRUCTURE AND MAGNETIC DEVICE

CROSS REFERENCE

This application is based upon and claims priority to Chinese Patent Application No. 201610353368.5, filed on May 25, 2016, the entire contents thereof are incorporated herein by reference.

TECHNICAL FIELD

The present disclosure relates to a core structure and a magnetic device.

BACKGROUND

With the rapid development of switching power supply technology in various application fields, more and more power products are developed towards higher efficiency, higher power density, higher reliability and lower cost. Usually, for high power supply, magnetic devices therein occupy a substantial proportion of the volumes, weights and losses. In order to meet the development of the power product, a core shape of the magnetic device generally requires customized design, which will seriously affect the development and manufacture of the power product.

The above information disclosed in the background technology section is only used to facilitate understanding the background of the present disclosure, and thus it may include information which does not construct the prior art well-known by the person skilled in the related art.

SUMMARY

According to an aspect of the present disclosure, a core structure includes a first magnetic cover, a second magnetic cover, and at least two winding columns and at least one common side column provided between the first magnetic cover and the second magnetic cover, and the at least two winding columns and the at least one common side column are opposite to each other. The side wall of the at least one common side column towards the at least two winding columns is provided with at least one first protrusion which extends towards the gap formed between the two adjacent winding columns.

According to another aspect of the present disclosure, a magnetic device includes a core structure according to present disclosure, at least one inductor winding and at least one transformer winding. Wherein, at least one of the at least two winding columns in the core structure is an inductor column, and at least one of the others is a transformer column. The at least one inductor winding respectively winds around at least one inductor column of the core structure. The at least one transformer winding respectively winds around the at least one transformer column of the core structure. The transformer includes a primary winding and a secondary winding.

The additional aspects and advantages of the present disclosure will be partly set forth in the following description, and partly become apparent from the description or learned from practice of the present disclosure.

BRIEF DESCRIPTION OF THE DRAWINGS

The above and other features and advantages of the present disclosure will become more apparent by describing exemplarily embodiments thereof with reference to the attached drawings.

DETAILED DESCRIPTION

Figure 1:
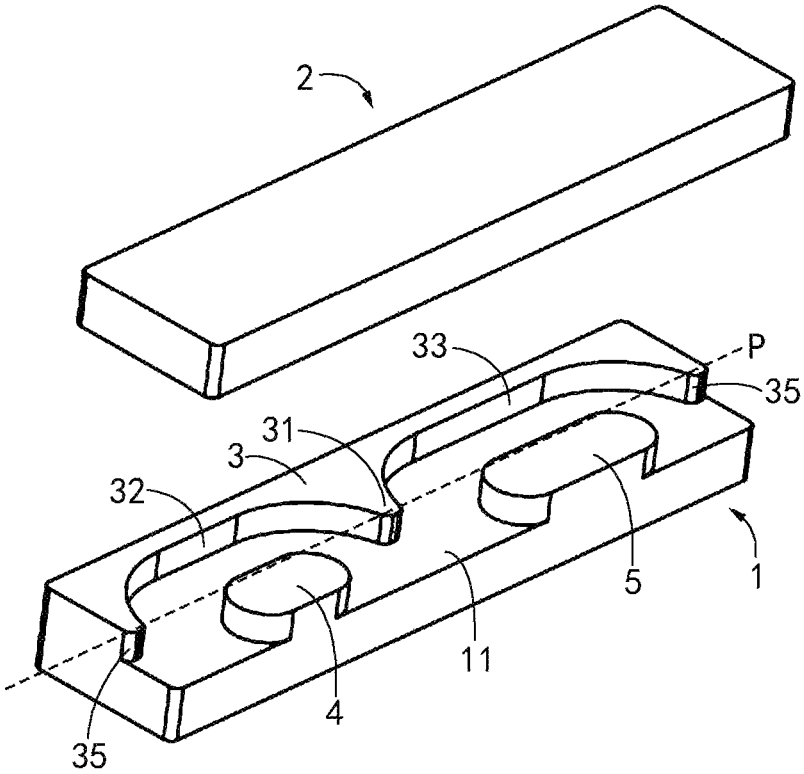
FIG. 1 is an exploded perspective view of the core structure according to an exemplary embodiment of the present disclosure.

Now, exemplary embodiments of the present disclosure will be more fully described with reference to the attached drawings. However, the exemplary embodiments can be implemented in various ways, and should not be construed as being limited to the embodiments set forth herein, rather, these embodiments are provided so that the present disclosure will be thorough and complete, and will fully convey the scope of the present disclosure to the person skilled in the related art. Throughout the drawings, the same reference numerals are used to refer to the same or similar structure, and thus its detail description will be omitted as necessary.

The terms "a", "an", "the" "said" and "at least one", when describing element/constituent/or the like as described and/or shown herein, are used to express the presence of one or more the elements/constituents/or the like. The terms "include", "comprise" and "have", as used herein, are intended to be inclusive, and mean there may be additional elements/constituents/or the like other than the listed elements/constituents/or the like. The relativity words, such as "upper" or "lower", as used herein, are used to describe the relative relationship of the referenced component to another component. It is appreciated that if the referenced device is inversed upside down, the component indicated as being the "upper" side would become the component on the "lower" side. In addition, the words "first", "second", or the like, as used in claims, are meant to indication, but not to limit the object to which they modify.

The present disclosure provides a new core structure and a magnetic device including the core structure, which integrate the functions of a transformer and an inductor.

Core Structure

Referring to FIG. 1. FIG. 1 is an exploded perspective view of the core structure according to an exemplary embodiment of the present disclosure. As shown in FIG. 1, the present core structure includes a first magnetic cover 1, a second magnetic cover 2, two winding columns 4, 5 and a common side column 3.

The first magnetic cover 1 and the second magnetic cover 2 may be disposed opposite to each other. Two winding columns 4, 5 and the common side column 3 may be disposed between the first magnetic cover 1 and the second magnetic cover 2.

In the embodiment as shown in FIG. 1, all of the winding columns 4, 5 and the common side column 3 may be provided on the first magnetic cover 1. However the present disclosure is not limited thereto, the winding columns 4, 5 and the common side column 3 may also be set by any other means, for example, the winding column 4 and the winding column 5 may be disposed on one of the first magnetic cover 1 and the second magnetic cover 2, and the common side column 3 may be disposed on the other one of the second magnetic cover 2 and the first magnetic cover 1; Alternatively, the winding column 4 and the common side column 3 may be provided on one of the first magnetic cover 1 and the second magnetic cover 2, and the winding column 5 may be provided on the other one of the second magnetic cover 2 and the first magnetic cover 1. Also, both of the first magnetic cover 1 and the second magnetic cover 2 may be provided with part of the winding columns 4, 5 and the common side column 3, etc.

One of two winding columns may be an inductor column, and the other one may be a transformer column. In one embodiment, the winding column 4 is an inductor column, and the winding column 5 is a transformer column. In one embodiment, the inductor column 4 and the transformer column 5 may both provided on the first surface 11 of the first magnetic cover 1 and located on the side of the first surface 11.

The inductor column 4 has a cross-section of circular, oval, runway shape or other shape, and the transformer column 5 has a cross-section of circular, oval, runway shape or other shape. The inductor column 4 may have the same cross-section shape as that of the transformer column 5 or not, which may be combined with any of the above shapes in any combination, for example, the inductor column 4 has a cross-section of oval shape, and the transformer column has a cross-section of runway shape. In some other embodiments, the inductor column 4 is provided with a first air gap, the transformer column 5 is provided with a second air gap.

Those skilled in the art will appreciate that the number of the winding column may not be limited to two, in some other embodiments, even more winding columns, for example, more inductor columns 4 and more transformer columns 5, or one inductor column 4 and more transformer columns 5 may be provided. In the present disclosure, the increase in power or in current may be achieved by increasing the number of the transformer column 5.

The common side column 3 is provided on the first surface 11 of the first magnetic cover 1 and located on the other side of the first surface 11, opposing to the inductor column 4 and the transformer column 5.

A first protrusion 31 may be provided on the side surface of the common side column 3 opposing to the two winding columns and extending towards the gap formed between the inductor column 4 and the transformer column 5. In one embodiment, the first protrusion 31 extends to or beyond a virtual surface P. The virtual surface P is defined as a surface connecting with side walls of the inductor column 4 and the transformer column 5 opposite to the common side column. 3. The side surface of the common side column 3 opposite to the inductor column 4 and the transformer column 5 includes two curved surfaces corresponding to the inductor column 4 and the transformer column 5 respectively, each of the two curved surface protrudes in a direction away from the corresponding winding column. More specifically, the curved surfaces 32 corresponding to the inductor column 4 protrudes in a direction away from the inductor column 4, and the curved surfaces 33 corresponding to the transformer column 5 protrudes in a direction away from the transformer column 5, that is to say, the curved surface may be partially surrounds the winding columns. The first protrusion 31 may be formed at the connection position of two curved surfaces 32, 33. In an embodiment, the first protrusion 31 may mainly support the core so as to maintain the air gap of the inductor or the transformer stable and to keep consistent inductance value.

The curved surface of the common side column 3 has a projection on the first magnetic cover 1, and the projection represents a circular, partial elliptical or partial runway shape. As shown in FIG. 1, two curved surfaces 32, 33 of the common side column 3 have the same shape. In other embodiment, multiple curved surfaces of the common side column 3 may be various.

In an embodiment, the curved surface of the common side column 3 has a shape corresponding to that of the winding column, for example, the inductor column 4 has a cross-section of runway shape, and accordingly the curved surface 32 oppositing the inductor column 4 has a shape of partial runway (see FIG. 1); The transformer column 5 has a cross-section of circular, and accordingly the curved surface 33 oppositing the transformer column 5 has a shape of circular arc surface. However, the present disclosure is not limited thereto, the curved surface of the common side column 3 may have a shape not compatible with that of cross-section of the winding columns. For example, the winding column has a cross-section of circular, whereas the curved surface has a shape of partial runway.

A receiving space is formed between the curved surface of the common side column 3 and the outside surface of the winding column such as the inductor column 4 or the transformer column 5, which may receive the corresponding winding such as the inductor winding or the transformer winding.

In other embodiment, a second protrusion 35 is provided at two end portions of the common side column 3 respectively, two second protrusions 35 may be corresponding to two end portions of the first magnetic cover 1 and may extend along the same direction as that of the first protrusion 31.

In an embodiment as shown in FIG. 1, the first magnetic cover 1, the inductor column 4, the transformer column 5 and the common side column 3 may collectively constitute a special E-type magnetic core; The second magnetic cover 2 may be an I-type magnetic core, thus forming an EI-type core structure by assembling the first magnetic cover 1 and the second magnetic cover 2.

Figure 2:
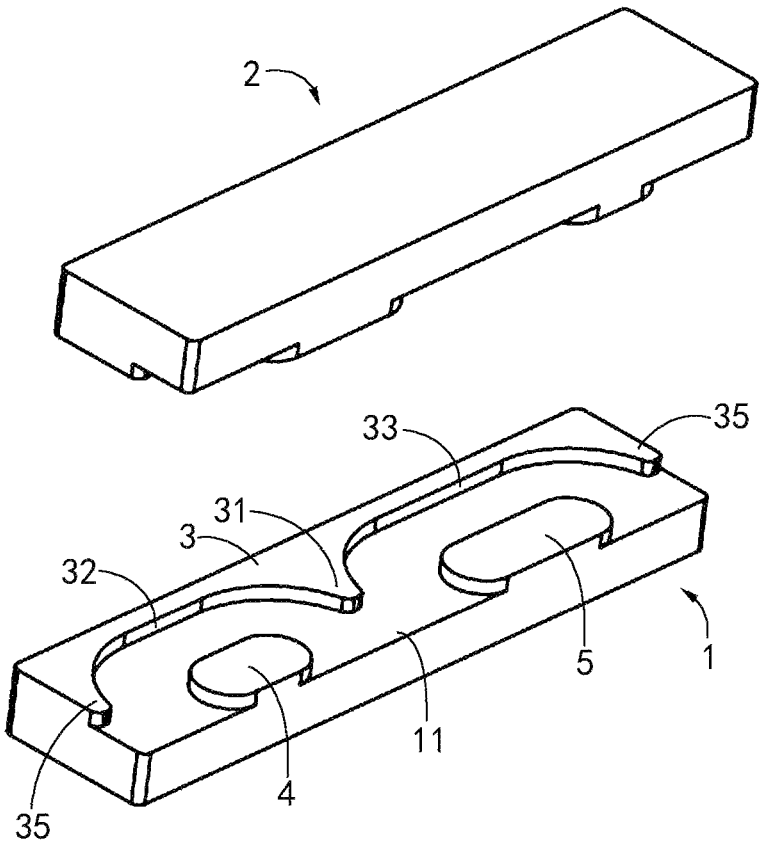
FIG. 2 is another exploded perspective view of the core structure according to an exemplary embodiment of the present disclosure.

Referring to FIG. 2, FIG. 2 is another exploded perspective view of the core structure according to an exemplary embodiment of the present disclosure. As shown in FIG. 2, The core structure includes a first magnetic cover 1, a second magnetic cover 2, two winding columns 4, 5 and a common side column 3.

The first magnetic cover 1 has the mirror structure as the second magnetic cover 2. The core structure as shown in FIG. 2 may be regarded as EE-type core structure.

Figure 3:
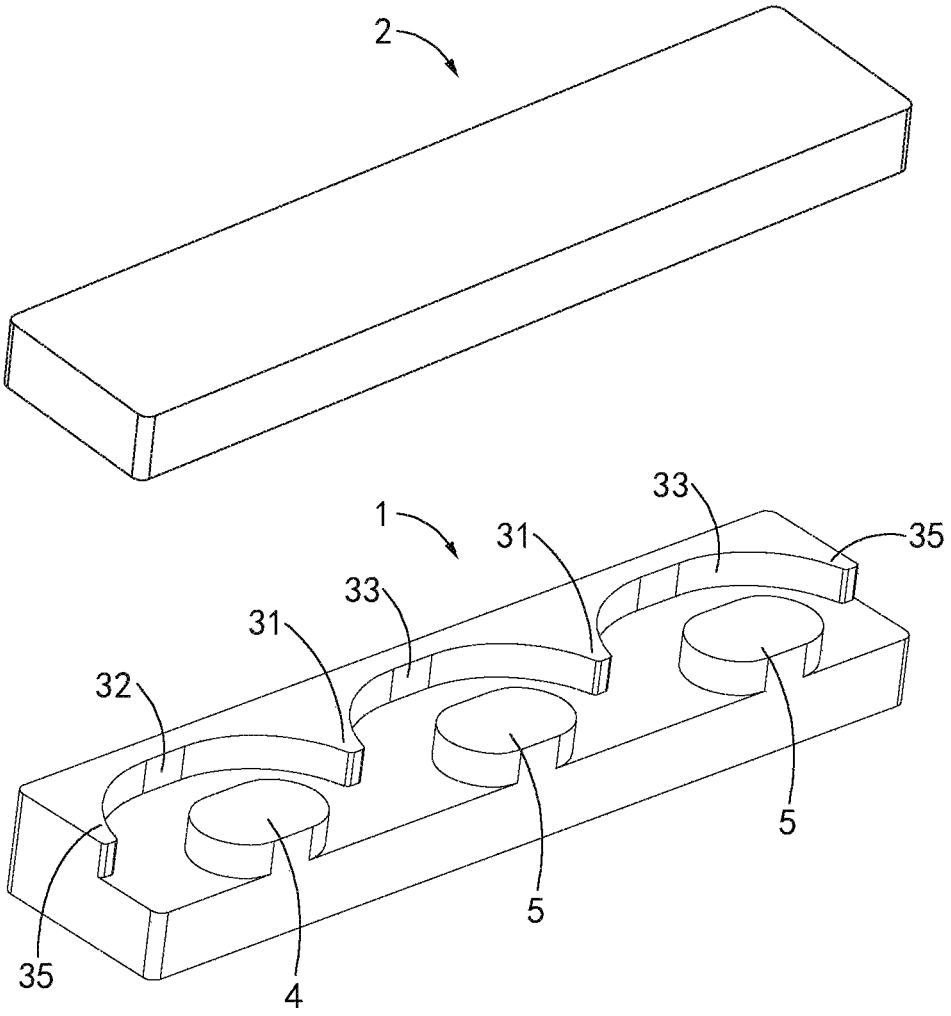
FIG. 3 is another exploded perspective view of the core structure according to an exemplary embodiment of the present disclosure.

Referring to FIG. 3, FIG. 3 is another exploded perspective view of the core structure according to an exemplary embodiment of the present disclosure. The core structure as shown in FIG. 3 differs from the core structure as shown in FIG. 1 in that the core structure has 3 winding columns which have same cross-sections or not. The 3 winding columns are respectively one inductor column 4 and two transformer columns 5; Accordingly, the common side column 3 may be provided with two first protrusions 31, one curved surface 32 corresponding to the inductor column 4, and two curved surfaces 33 corresponding to the transformer columns 5. The two first protrusions 31 of the common side column 3 extend towards the gap formed between the inductor column 4 and the transformer column 5, and the gap formed between two adjacent transformer columns 5.

Other portions of the core structure as shown in FIG. 3 is virtually identical to that of FIG. 1, Thus, detailed description thereof will be omitted.

Figure 4:
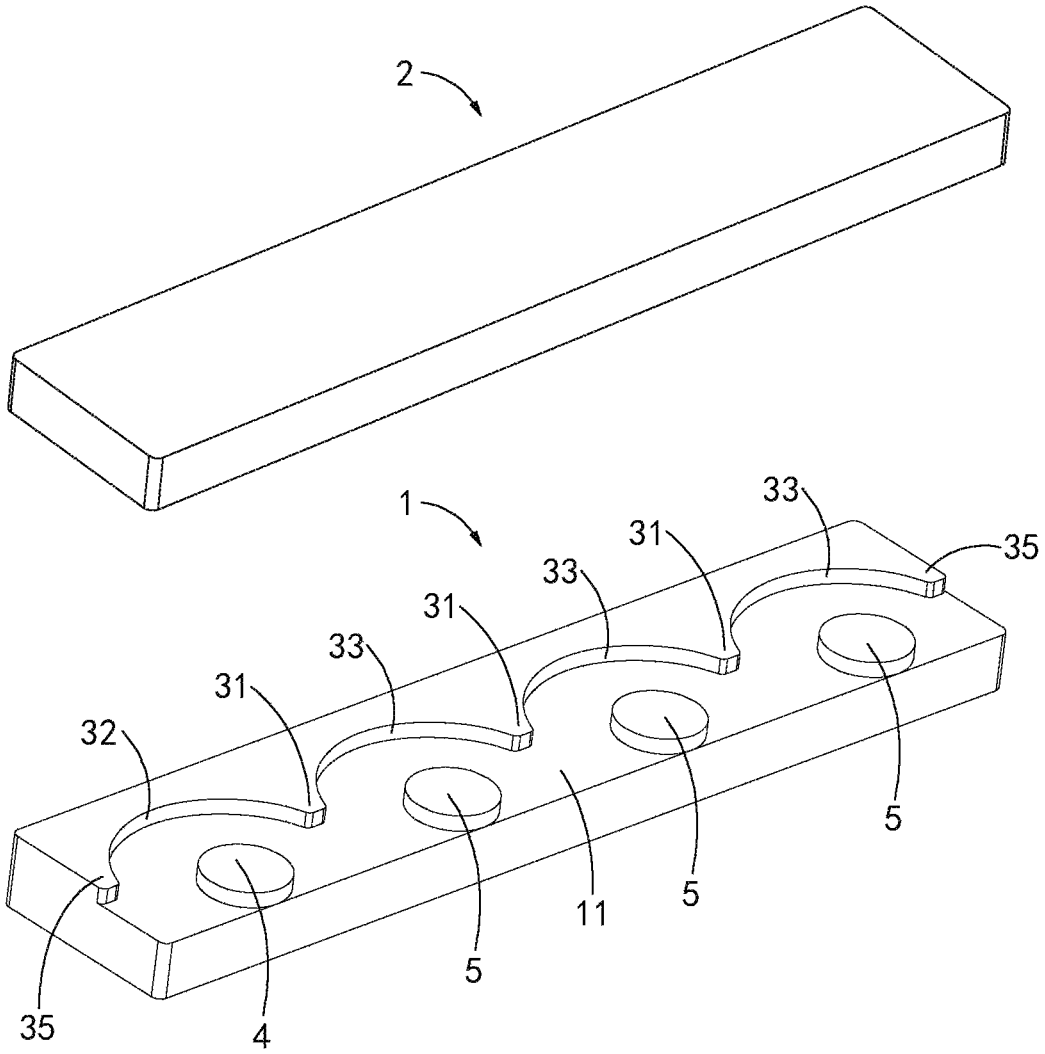
FIG. 4 is another exploded perspective view of the core structure according to an exemplary embodiment of the present disclosure.

Referring to FIG. 4, FIG. 4 is another exploded perspective view of the core structure according to an exemplary embodiment of the present disclosure. The core structure as shown in FIG. 4 differs from the core structure as shown in FIG. 1 is that the core structure has four winding columns which have identical cross-sections such as circle. The four winding columns may also have different cross-sectional shapes. The four winding columns may be one inductor column 4 and three transformer columns 5; Accordingly, the common side column 3 has three first protrusions 31, one curved surface 32 corresponding to the inductor column 4 and three curved surfaces 33 corresponding to the transformer columns 5.

Other portions of the core structure as shown in FIG. 4 is virtually identical to that of FIG. 1, detailed description thereof will be omitted.

The core structure according to the present disclosure integrated with the functions of an inductor and a transformer has a smaller size, which is particularly suitable for low-voltage and high-current applications. The increase in power or in current may be achieved by appropriately adding the number of the winding columns used for windings, thereby high-efficiency and low-cost may be realized under the condition of substantially maintaining a constant number of PCB layers. The core structure of the present disclosure is not only easy to implement power spreading, but also is beneficial to avoid heat dissipation issues and cost issues caused by increasing the number of PCB layers.

Magnetic Device

Figure 5:
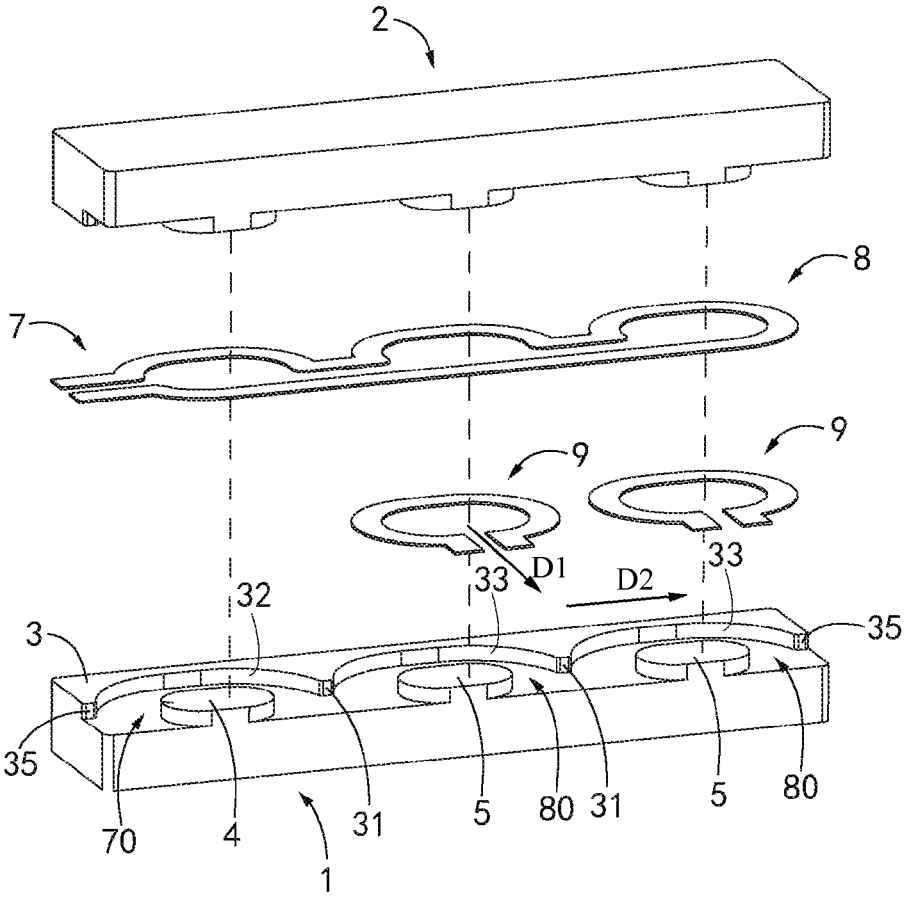
FIG. 5 is an exploded perspective view of the magnetic device according to an exemplary embodiment of the present disclosure.

Referring to FIG. 5, FIG. 5 is an exploded perspective view of the magnetic device according to an exemplary embodiment of the present disclosure. The magnetic device includes a core structure, at least one inductor winding and at least one transformer winding.

As shown in FIG. 5, the core structure in the magnetic device may be the core structure according to present disclosure, which includes a first magnetic cover 1, a second magnetic cover 2, an inductor column 4, two transformer columns 5 and a common side column 3. The common side column 3 includes two first protrusions 31, one curved surface 32 and two curved surfaces 33.

A receiving space for inductor winding 70 may be formed between the outside surface of the inductor column 4 and the curved surface 32 of the common side column 3. Receiving spaces for transformer winding 80 may be formed between the outside surfaces of the transformer columns 5 and two curved surfaces 33 of the common side column 3, respectively.

The inductor winding 7 may be wound around the inductor column 4 in the core structure, and located in the receiving space 70 for inductor winding. Two transformer windings may be wound around two transformer columns 5 in the core structure, respectively, and located in corresponding receiving spaces for transformer winding 80. Each of the transformer may include a primary winding 8 and a secondary winding 9.

The inductor winding 7 and the primary winding 8 of the transformer may formed by an entire wire, thus the inductor winding 7 and the primary winding 8 have a common lead wire. The inductor winding 7 and the primary winding 8 may wind around all of the winding columns, and the common lead wire has a direction consistent with the line connecting the at least two winding columns in the core structure. That is to say, the lead wire has a lead direction along the arrangement direction of the at least two winding columns. As shown in FIG. 5, the lead wire may outgo towards to the left end of the first magnetic cover 1.

The secondary winding 9 may be formed separately from the inductor winding 7 and the primary winding 8. The secondary winding has a lead direction far away from the common side column 3, and the lead direction may be perpendicular to the length direction of the common side column 3, ie, the arrangement direction of the inductor column 4 and the transformer column 5. As shown in FIG. 5, the lead direction of primary winding 8 of the transformer may be perpendicular to that of the secondary winding 9. It should be understood that in the present disclosure, the angle between the lead direction of the secondary winding 9 and the length direction of the common side column 3 (the arrangement direction of the inductor column 4 and multiple the transformer columns 5) may not be limited to 90 degree, The angle may be in range of 45°~135°, for example, 100°, 110°, 120°, 130°, etc. In some embodiments, the outputs of the secondary winding 9 may be connected in parallel with each other.

Wherein, the wire formed the inductor winding 7, the primary winding 8, and the secondary winding 9 may be enameled wires, triple insulated wires or a PCB wires formed in a PCB board, etc.

It should be understood that, just as the number and the position of the inductor column 4 and the transformer column 5 may not be limited in the core structure of the present disclosure, the number of the inductor winding 7 and the number the transformer winding may not be limited, the number of the inductor winding 7 may be multiple, and the number of the transformer winding may be one, also may be multiple, for example, three, four, ten, etc.

Figure 6:
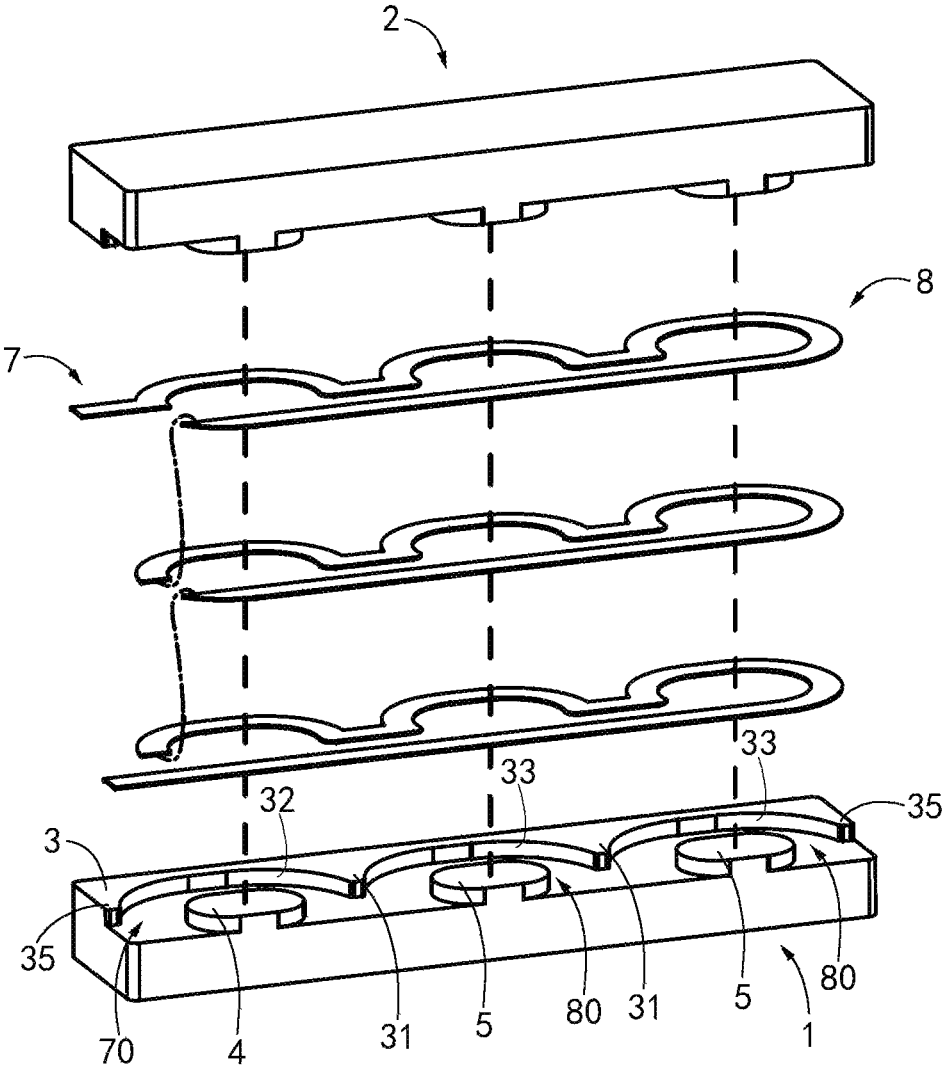
FIG. 6 is another exploded perspective view of the magnetic device according to an exemplary embodiment of the present disclosure.

Referring to FIG. 6, FIG. 6 is another exploded perspective view of the magnetic device according to an exemplary embodiment of the present disclosure. As shown in FIG. 6, the primary winding 8 of the transformer and the inductor winding 7 may be formed by the same wire, which winds all of the winding columns. Wherein the wire may be a continuous enameled wire, a triple insulated wire or a PCB wire, also the wire may be multiple enameled wires, triple insulated wires or PCB wires connected in series. For example, as shown in FIG. 6, the wire includes three sections which may be connected end-to-end to form a series connection, each of the sections may winds one inductor column 4 and two transformer columns 5 substantially in a connected "C" shape which located between the winding columns and the common side column 3 therein. A part of the winding corresponding to the inductor column 4 may form the inductor winding 7, and a part of the winding corresponding to the transformer column 5 may form the primary winding 8. The secondary winding is not shown in FIG. 6.

Using the winding manner of the primary winding 8 and the inductor winding 7 as shown in FIG. 6, the primary winding 8 of the transformer and the inductor winding 7 may have the same number of turns. In other embodiment, the number of turns of the primary winding 8 and the inductance winding 7 may be different.

Figure 7:
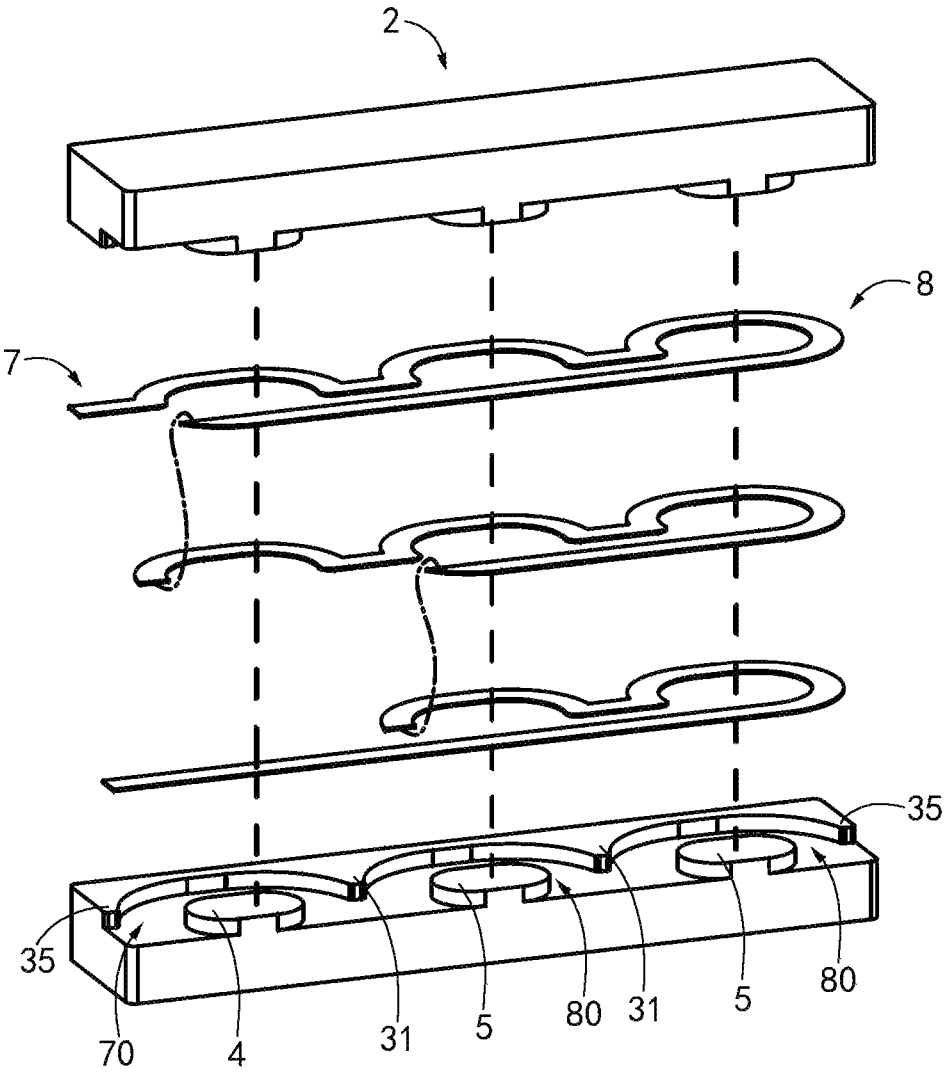
FIG. 7 is another exploded perspective view of the magnetic device according to an exemplary embodiment of the present disclosure.

For example, as shown in FIG. 7, the primary winding 8 and the inductor winding 7 may be formed by the same wire. The wire includes three sections connected in series, and may surround different number of the winding columns, respectively. For example, one of the three sections winds two transformer columns 5, and the other two sections wind two transformer columns 5 and the inductor column 4, thus the number of turns of the primary winding 8 of the transformer is more than that of the inductor winding 7. The secondary winding is not shown in FIG. 7.

Figure 8:
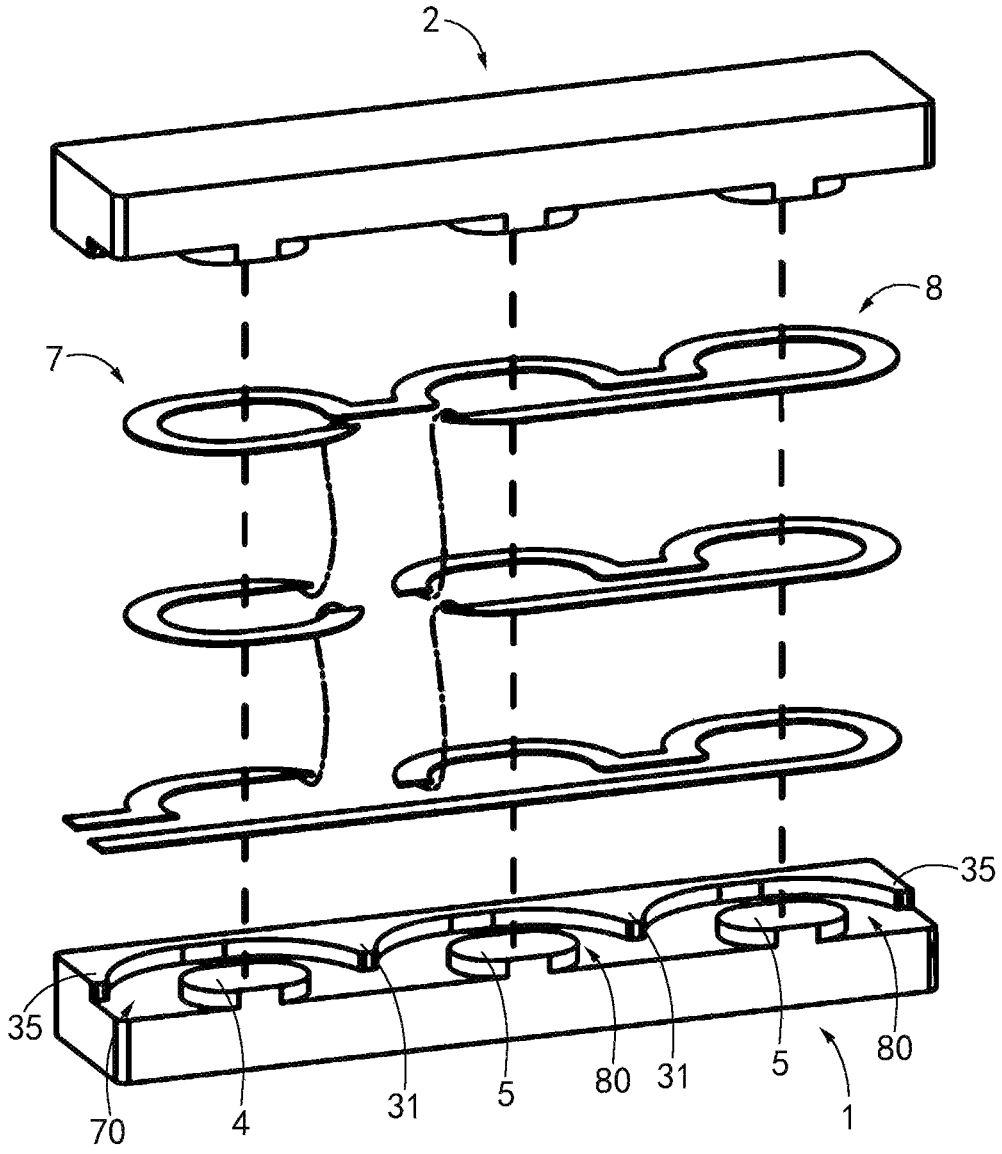
FIG. 8 is another exploded perspective view of the magnetic device according to an exemplary embodiment of the present disclosure.

Referring to FIG. 8, FIG. 8 is another exploded perspective view of the magnetic device according to an exemplary embodiment of the present disclosure. The magnetic device as shown in FIG. 8 differs from the magnetic device as shown in FIG. 6 in that the inductor winding 7 and the primary winding 8 of the transformer may be formed by the same wire, whereas the wire of the inductor winding 7 only winds the inductor column 4 rather than the transformer column 5; and the wire of the primary winding 8 only winds the transformer column 5 rather than the inductor column 4. In particular, the wire formed the inductor winding 7 includes multiple sections connected in series, and each of the sections individually surrounds the inductor column 4. The wire formed the primary winding 8 includes multiple sections connected in series, and each of the sections individually surrounds the transformer column 5. The secondary winding is not shown in FIG. 8.

Other portions of the magnetic device as shown in FIG. 7 and FIG. 8 are virtually identical to that of FIG. 6, detailed description thereof will be omitted.

Figure 9:
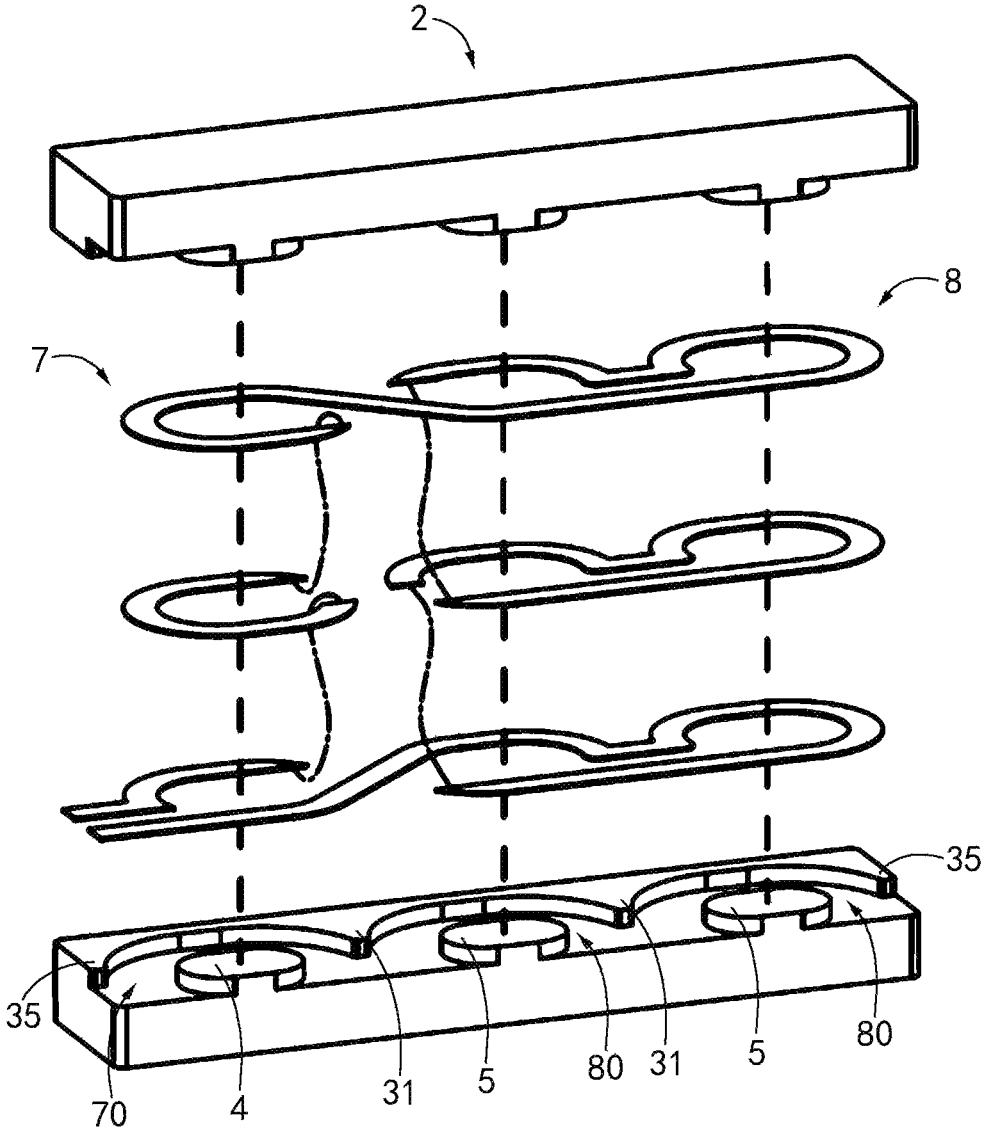
FIG. 9 is another exploded perspective view of the magnetic device according to an exemplary embodiment of the present disclosure.

Referring to FIG. 9, FIG. 9 is another exploded perspective view of the magnetic device according to an exemplary embodiment of the present disclosure. The magnetic device as shown in FIG. 9 differs from the magnetic device as shown in FIG. 6 in that the wire formed the inductor winding 7 and the primary winding 8 is substantially in a "∞" shape. Usually, the wire of the inductor winding 7 and the primary winding 8 are wound in opposite directions, which may help to form this "∞" type of winding. In particular, the wire of the inductor winding 7 may be wound in a clockwise direction, and the wire of the primary winding 8 may be wound in a counterclockwise direction. Thus the wire of the inductor winding 7 intersects the wire of the primary winding 8, thereby forming "∞" type winding structure. Similarly, in case that the wire of the inductor winding 7 is wound in a counterclockwise direction, and the wire of the primary winding 8 is wound in a clockwise direction, the "∞" type winding structure may also be formed with the wire of the inductor winding 7 and the wire of the primary winding 8. With this winding method, the magnetic flux in the common winding column may form a reverse flow, which may either effectively reduce the magnetic flux density and core losses or reduce the size of the core volume.

Other portions of the magnetic device as shown in FIG. 9 is virtually identical to that of FIG. 6, detailed description thereof will be omitted.

Figure 10:
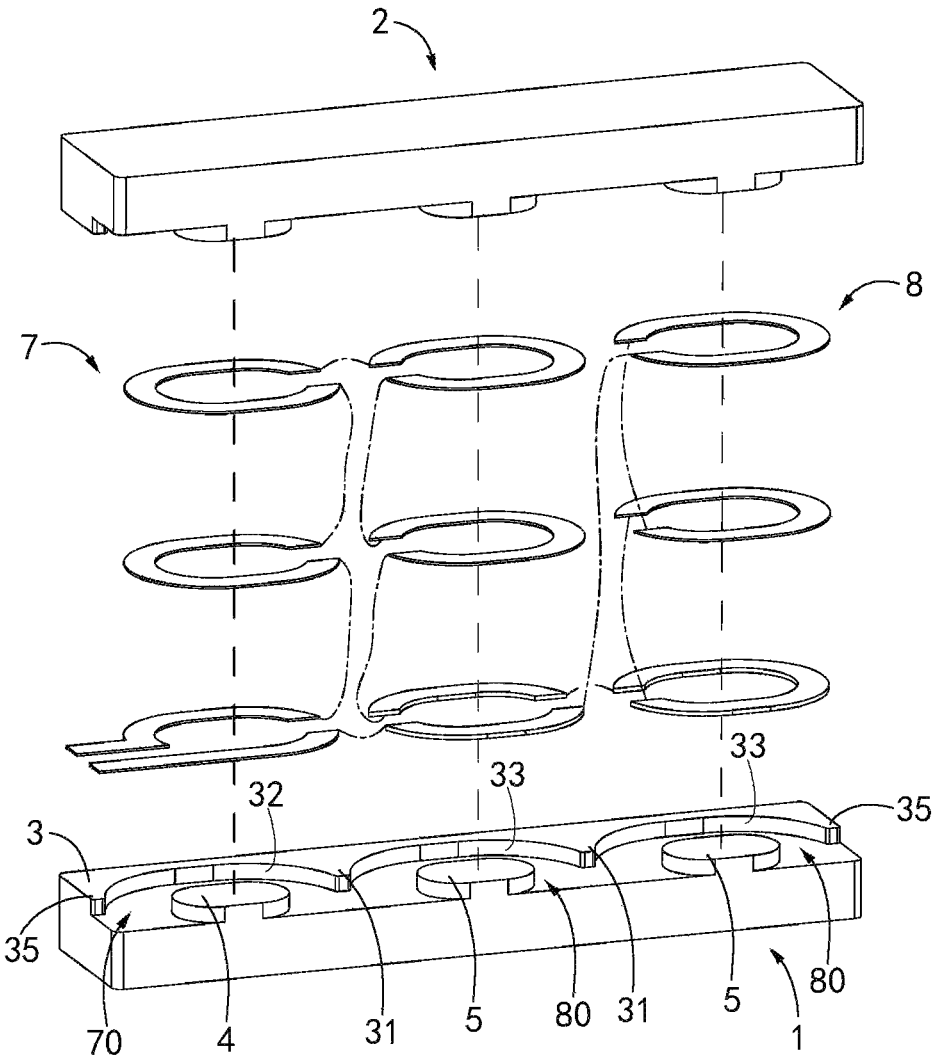
FIG. 10 is another exploded perspective view of the magnetic device according to an exemplary embodiment of the present disclosure.

Referring to FIG. 10, FIG. 10 is another exploded perspective view of the magnetic device according to an exemplary embodiment of the present disclosure. The magnetic device as shown in FIG. 10 differs from the magnetic device as shown in FIG. 6 in that each of the wires of the inductor winding 7 and the wires of the primary windings 8 of the transformer columns may be wound firstly around the corresponding winding columns respectively, and then connected together in sequence. Specifically, the inductor winding 7 includes three sections, each of which may be wound around the inductor column 4, respectively; Each of the primary windings 8 of the transformer includes three sections, each of which may be wound around the transformer columns 5, respectively. The three sections formed the inductor winding 7 and six sections formed two primary windings 8 of two transformers added together are 9 sections, which may be connected in sequence. The number of wires of the inductor winding 7 may be not limited to 3 sections, which may be properly increased or decreased according to actual requirement. Similarly, the number of wires of the primary winding 8 of the transformer may be not limited to 3 sections, and may be properly increased or decreased according to actual requirement.

Other portions of the magnetic device as shown in FIG. 10 is virtually identical to that of FIG. 6, detailed description thereof will be omitted.

The exemplary embodiments of the present disclosure have been shown and described above. It should be understood that the present disclosure would never be limited to the disclosed embodiments, rather, the present disclosure is intended to cover various modification and equivalent arrangement fallen within the spirit and scope of the attached claims.

What is claimed is:

1. A core structure, comprising:

a first magnetic cover and a second magnetic cover;

at least two winding columns and at least one common side column provided between the first magnetic cover and the second magnetic cover, and the at least two winding columns and the at least one common side column are opposite to each other, and a side wall of the at least one common side column towards the at least two winding columns is provided with at least one first protrusion which extends towards a gap formed between the two adjacent winding columns, wherein at least one of the at least two winding columns is an inductor column, and at least one of the others is a transformer column;

at least one inductor winding, respectively winds around the at least one inductor column of the core structure; and at least one transformer winding, respectively winds around at least one transformer column of the core structure, and the transformer winding comprises primary winding and secondary winding, wherein the inductor winding and the primary winding are formed by one wire and winds around all of the winding columns, a winding direction of the inductor winding and a winding direction of the primary winding are opposite to each other.

2. The core structure according to claim 1, wherein the at least two winding columns are provided on either of the first magnetic cover and the second magnetic cover, and the at least one common side column is provided on either of the first magnetic cover and the second magnetic cover.

3. The core structure according to claim 1, wherein a portion of each winding column and that of each common side column are provided on the first magnetic cover, and the other portion of each winding column and that of each common side column are provided on the second magnetic cover.

4. The core structure according to claim 1, wherein one or more of the winding columns have a cross-section of circular, oval or runway shape.

5. The core structure according to claim 1, wherein at least one of the at least two winding columns is an inductor column, and at least one of the others is a transformer column.

6. The core structure according to claim 1, wherein the side wall of the common side column comprises at least two curved surfaces which are respectively corresponding to the at least two winding columns, and two adjacent curved surfaces form the first protrusion at the position where they are connected together.

7. The core structure according to claim 1, wherein a projection of the curved surface on the first magnetic cover or on the second magnetic cover has a circular, partial elliptical or partial runway shape.

8. The core structure according to claim 1, wherein the first protrusion extends towards the gap formed between the adjacent two winding columns to or beyond a virtual surface which is formed by means of connecting with the side walls of the at least two winding columns opposite to the common side column.

9. The core structure according to claim 1, wherein a second protrusion is provided at each of the two end portions of the common side column respectively, and the two second protrusions correspond to two end portions of the first magnetic cover or the second magnetic cover and extend along the same direction as that of the first protrusion.

10. The core structure according to claim 5, wherein a first air gap is formed on the at least one inductor column, a second air gap is formed on the at least one transformer column.

11. The core structure according to claim 1, wherein three winding columns and at least one common side column provided between the first magnetic cover and the second magnetic cover, one of the three winding columns is an inductor column, and two of the three winding columns are transformer columns, and the side wall of the at least one common side column towards the three winding columns is provided with two first protrusions which one of the two first protrusions extends towards the corresponding gap formed between two adjacent winding columns of the three winding columns.

12. The core structure according to claim 1, wherein four winding columns and at least one common side column provided between the first magnetic cover and the second magnetic cover, one of the four winding columns is an inductor column, and three of the four winding columns are transformer columns, and the side wall of the at least one common side column towards the four winding columns is provided with three first protrusions which one of the three first protrusions extends towards the corresponding gap formed between two adjacent winding columns of the four winding columns.

13. A magnetic device, comprising:

a core structure according to claim 1.

14. The magnetic device according to claim 13, wherein the wire formed the inductor winding and the primary winding is substantially in a "∞" shape, or each of the wires of the inductor winding and the wires of the primary windings wind firstly around the corresponding winding columns respectively, and then connected together in sequence, or the wire formed the inductor winding and the primary winding is substantially in a connected "C" shape which located between the winding columns and the common side column.

15. The magnetic device according to claim 14, wherein the number of the winding columns is three or four.

16. The magnetic device according to claim 13, wherein a lead direction of the wire is consistent with the line connecting the at least two winding columns in the core structure.

17. The magnetic device according to claim 13, wherein the side surfaces of the wire opposite to the common side column has a shape consistent with the side surfaces of the common side column.

18. The magnetic device according to claim 13, wherein the wire is a PCB wire formed in a PCB board.

19. The magnetic device according to claim 13, wherein the secondary winding comprises at least one secondary winding, and each of the at least one secondary winding winds around the at least one transformer column, respectively.

20. The magnetic device according to claim 19, wherein the secondary winding has a lead direction far away from the common side column, and the lead direction forms an angle ranged 45°~135° with the length direction of the common side column.

21. The magnetic device according to claim 19, wherein the wire of the secondary winding is a PCB wire formed in a PCB board.

* * * * *